US007289082B2

(12) United States Patent
Condon et al.

(10) Patent No.: US 7,289,082 B2
(45) Date of Patent: Oct. 30, 2007

(54) PANEL ANTENNA ARRAY

(75) Inventors: Ed Condon, Murphy, TX (US); Richard Smith, Dallas, TX (US); Monte Curran, Argyle, TX (US); William Oliver, Frisco, TX (US); Mitch Johnson, McKinney, TX (US); Wenhua Zhou, Plano, TX (US); John Grabner, Plano, TX (US)

(73) Assignee: Navini Networks, Inc., Richardson, TX (US)

( * ) Notice: Subject to any disclaimer, the term of this patent is extended or adjusted under 35 U.S.C. 154(b) by 51 days.

(21) Appl. No.: 11/070,962

(22) Filed: Mar. 3, 2005

(65) Prior Publication Data

US 2006/0055621 A1 Mar. 16, 2006

Related U.S. Application Data

(60) Provisional application No. 60/610,009, filed on Sep. 14, 2004.

(51) Int. Cl.
*H01Q 21/00* (2006.01)

(52) U.S. Cl. ..... 343/893; 343/853; 343/872

(58) Field of Classification Search ..... 343/872, 343/893

See application file for complete search history.

(56) References Cited

U.S. PATENT DOCUMENTS

| | | | | |
|---|---|---|---|---|
| 5,966,102 | A * | 10/1999 | Runyon | 343/820 |
| 6,067,053 | A * | 5/2000 | Runyon et al. | 343/797 |
| 2004/0060662 | A1 * | 4/2004 | Yeom et al. | 156/345.48 |
| 2004/0150561 | A1 * | 8/2004 | Tillery et al. | 343/700 MS |

* cited by examiner

*Primary Examiner*—Don Wong
*Assistant Examiner*—Binh Van Ho
(74) *Attorney, Agent, or Firm*—K & L Gates LLP

(57) ABSTRACT

A system is disclosed for providing a new panel antenna array with enhanced environmental protection, increased reliability and simplified assembly through the incorporation of new array structures. In one embodiment, a panel antenna array system comprises one or more linear arrays having one or more radiating elements for providing antenna transmission and reception; and one or more protection modules to be aligned vertically with each other in a parallel fashion, with each protection module providing protection to one linear array. A mounting bracket further provides a mounting surface to the protection modules.

18 Claims, 3 Drawing Sheets

PANEL ANTENNA ARRAY

CROSS-REFERENCE

The present invention claims the benefit of U.S. Provisional Patent Application Ser. No. 60/610,009, which was filed Sep. 14, 2004 entitled "PANEL ANTENNA ARRAY."

BACKGROUND

This invention relates generally to antenna arrays, and more particularly to improved structures for panel antenna arrays.

Antennas of various types are used in modern communication systems, such as personal communications services (PCS) systems, cellular radiotelephone systems, etc. These antennas are typically mounted outdoors and are subject to harsh environmental conditions. Furthermore, these antennas must operate while exposed to direct sunlight, wind, rain, snow, ice, etc., for extended periods of time.

Conventional panel antenna arrays consist of multiple linear arrays, a metal backbone, and a radome, which is a non-metallic cover protecting one or more linear arrays from environmental conditions detrimental to the proper functioning thereof. A linear array consists of one or more radiating elements, as well as a contiguous ground plane. The metal backbone is commonly used as the ground plane for all radiating elements. Conventional panel antenna arrays must be environmentally sealed to protect the internal components from damage and corrosion that adversely affect their operational reliability. Therefore, a seal on the entire circumference between the array backbone and the array radome is generally required to prevent infiltration of undesired elemental contaminants, such as water, ice, sand, etc. These long seals present points of potential seal degradation and intrusion of unwanted contaminants.

A common desired characteristic for planar antenna arrays is its "high power", or "high gain" capability, which can be made possible by increasing the number of radiators in each linear array. This "high power" capability can also be derived by increasing the number of linear arrays in the panel antenna array, assuming that the correct radiator spacing is still maintained. However, this setup typically requires a disproportionate increase in overall antenna array size, weight, and assembly complexity. Another disadvantage is that as the size of the panel antenna array is increased, so is the increase in wind loading, which then requires heavier mounting brackets and structural changes that are both economically and spatially inefficient.

Therefore, desirable in the art of panel antenna array designs are improved structures for panel antenna arrays that provide enhanced environmental protection, increased reliability, simplified antenna array assembly, decreased weight, and reduced fabrication/assembly costs.

SUMMARY

In view of the foregoing, this invention provides a new panel antenna array with enhanced environmental protection, increased reliability and simplified assembly through the incorporation of new array structures.

In one embodiment, a panel antenna array system comprises one or more linear arrays having one or more radiating elements for providing antenna transmission and reception; and one or more protection modules to be aligned vertically with each other in a parallel fashion, with each protection module providing protection to one linear array. A mounting bracket further provides a mounting surface to the protection modules. By providing a dedicated protection module for each linear array, and by providing a predetermined space between these protection modules, wind load factor, overall system weight and system's spatial footprint may be reduced.

The construction and method of operation of the invention, however, together with additional objects and advantages thereof will be best understood from the following description of specific embodiments when read in connection with the accompanying drawings.

DESCRIPTION

The following will provide a detailed description of a panel antenna array with enhanced environmental protection, increased reliability and simplified assembly.

Figure 1:
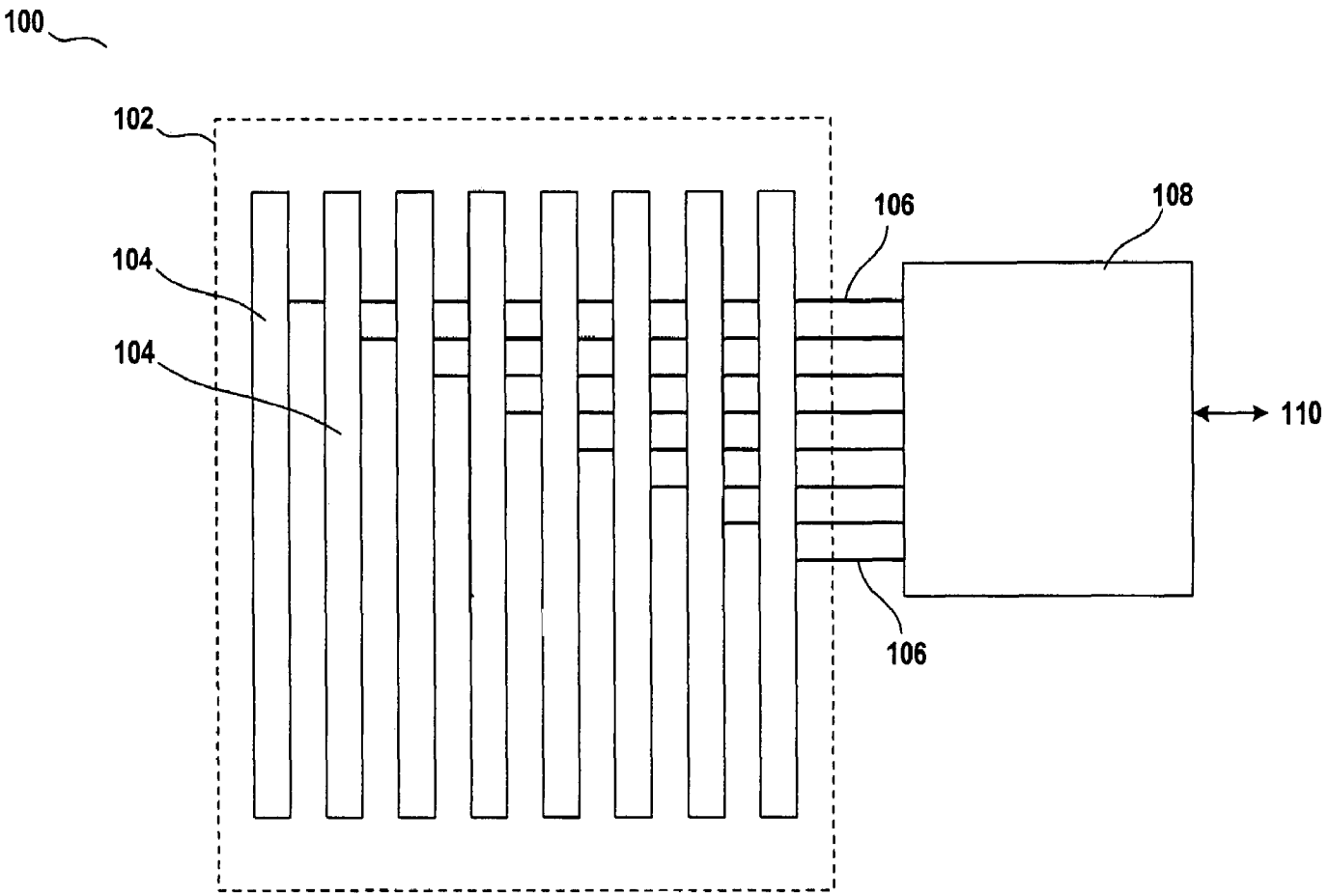
FIG. 1 (PRIOR ART)
FIG. 1 presents a conventional panel antenna array.

FIG. 1 presents a schematic diagram of a conventional panel antenna array 100. The conventional panel antenna array 100 comprises one or more linear arrays 104, all of which are housed in and sealed by a single, large non-metallic radome 102. Each linear array 104 is mounted vertically with spacing between each other, with the said spacing determined by the desired resonant frequency to be transmitted or received by the conventional panel antenna array 100. Each linear array 102 is connected, via an antenna feed 106, to its associated radio frequency (RF) electronics circuitry contained in an external RF electronics module 108. The RF electronics module 108 may be physically mounted on the radome 102, or may be remotely located. It is understood that the RF electronics module 108 is connected to external systems via a connection 110 for power, control, and communications connections.

In this conventional design, since the radome 102 is designed to house all of the linear arrays 104, it is big, heavy and spatially inefficient. In addition, this conventional design typically employs a seal and/or water resistant joint along the entire surface connecting the radome 102 and a backbone that holds one or more linear arrays 104. Since panel antenna arrays are typically deployed outdoors and are directly exposed to the ambient environment, the probability that one or more of these large seals may degrade, due to overexposure to ambient environment, is significantly increased.

Figure 2B:
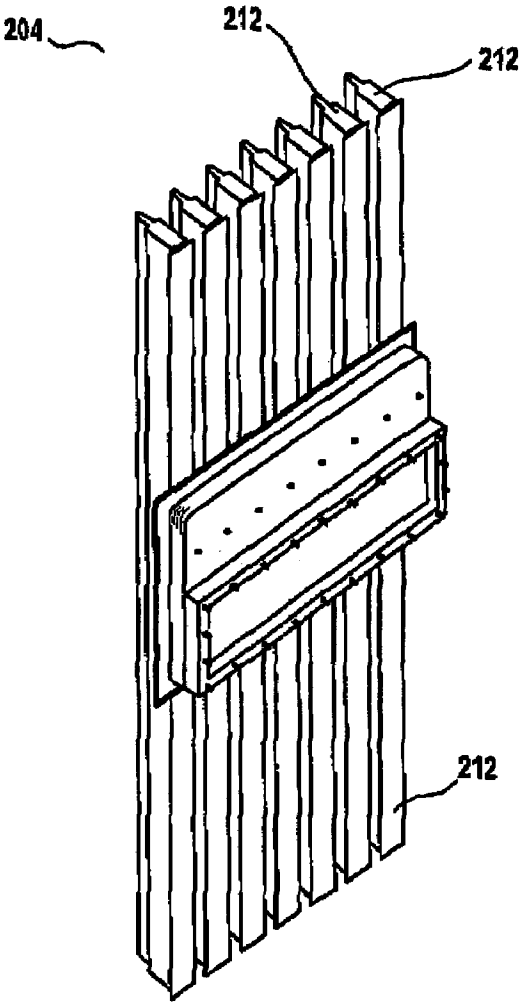
FIGS. 2A and 2B present a top view and an isometric view of a new panel antenna array in accordance with one embodiment of the present invention.
Figure 2A:
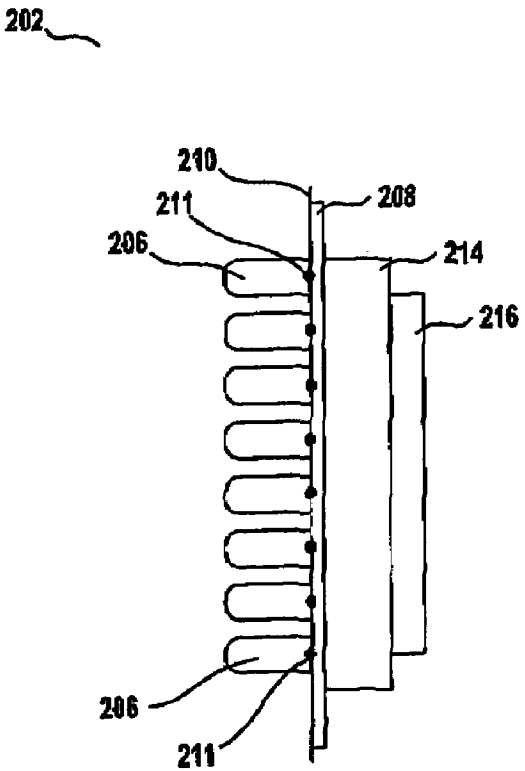

FIGS. 2A and 2B present a top view 202 and an isometric view 204 of a new panel antenna array in accordance with one embodiment of the present invention. In FIG. 2A, the new panel antenna array comprises multiple linear array assemblies 206, each of which further contains a linear array, not shown. Each linear array assembly 206 is mounted vertically on a mounting bracket 208 in the illustrated exemplary embodiment but other arrangements may be used in other embodiments the linear array assembly 206 is generally tubular in shape. The rear flat surfaces of the linear array assemblies 206 are joined to the mounting bracket 208 and aligned using alignment pins, not shown, and secured together using a structural acrylic adhesive sheet 210. This structural acrylic adhesive sheet 210 eliminates the need for mechanical fasteners, such as nuts and bolts, that are commonly used in conventional designs to secure any radome design to a mounting bracket holding one or more linear arrays. The elimination of mechanical fasteners increases protection against infiltration of undesired elemental contaminants, such as water, ice, sand, etc., while providing the necessary structural strength at a reduced weight. The structural acrylic adhesive sheet 210 also acts as an environmental seal around an antenna feed point 211 at each of the linear array assemblies 206. It is understood that each antenna feed point 211 is a small opening at the flat rear surface of each linear array assembly 206.

As shown in FIG. 2A, RF electronics modules 214 and 216 are attached to the mounting bracket 208. It is understood that one or more short, internal cables are used to electrically connect the linear array assemblies 206, via the antenna feed points 211, to the RF electronics module 214. RF electronics modules 214 and 216 are coupled to the mounting bracket to provide one or more radio or electrical functions to the linear arrays.

It is further understood that additional linear array assemblies 206 may be added to obtain the desired antenna gain characteristics. The spacing between each linear array assembly 206 is determined by the desired resonant frequency to be transmitted or received by the panel antenna array.

Each linear array assembly 206 houses one linear array, thereby acting as a radome and providing dedicated protection. As shown in FIG. 2B, after a linear array is placed (by way of sliding, for example) into one end of each linear array assembly 206, the top and bottom of each linear array assembly 206 are sealed from the environment with end caps 212. The linear array may be slidable with respect to linear array assembly 206. An interlocking mechanism is further provided with each end cap 212 such that a chain of end caps 212 interlocks laterally to provide additional overall structural rigidity. It is further understood that the end caps 212 placed at the bottom of the linear array assemblies 206 may optionally contain a valve to allow any condensed moisture to escape.

Figure 3B:
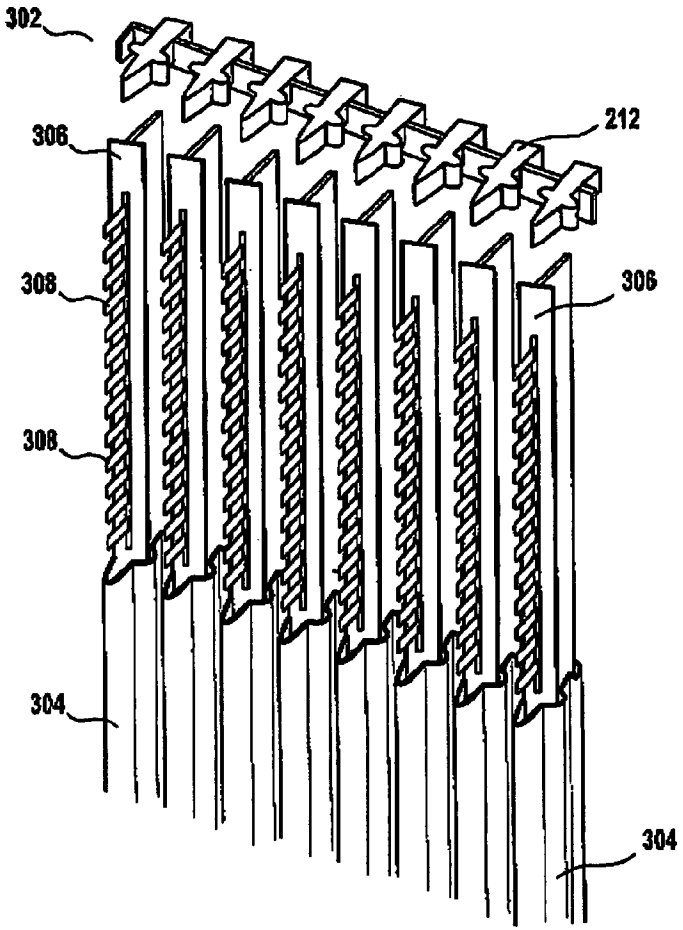
FIGS. 3A and 3B present two detailed views of the new panel antenna array in accordance with one embodiment of the present invention.
Figure 3A:
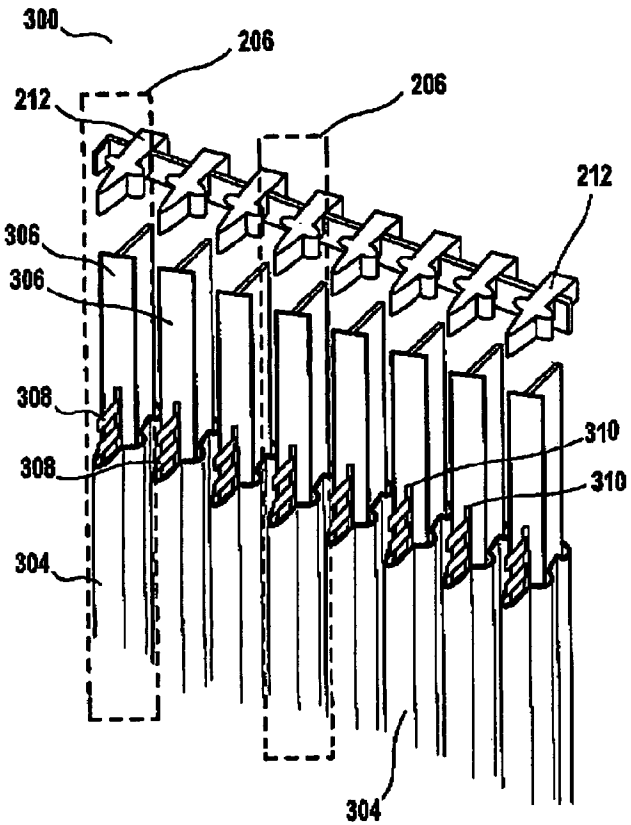

FIGS. 3A and 3B present detailed views 300 and 302 of the new panel antenna array in accordance with one embodiment of the present invention. In FIG. 3A, it is shown that eight linear array assemblies 206 are used to construct the new panel antenna array. Each of the linear array assemblies 206 comprises a hollow non-metallic extrusion 304, a metallized plastic extrusion 306, a plurality of linear array elements 308 in a linear array, an end cap 212 for the top thereof, and another end cap, not shown, for the bottom thereof. It is understood that the hollow non-metallic extrusion 304 may be seen as a protection module for environmentally isolating a linear array. Hollow non-metallic extrusion 304 is a generally tube shaped member with a cross sectional shape that accommodates the components housed therein. It is further understood by those skilled in the art that the linear array elements 308, which are radiating elements for wireless communications, are electrically connected to form a linear array, which is then assembled onto the metallized plastic extrusion 306 such that each linear array element 308 extends through a front slot 310 in the metallized plastic extrusion 306. An antenna feed may connect to the linear array at the rear of the metallized plastic extrusion 306. Physical assembly includes at least sliding the linear array into the metallized plastic extrusion 306, and further sliding the metallized plastic extrusion 306 into the hollow non-metallic extrusion 304. The metallized plastic extrusion 306, acting as a centering module, centers the linear array within the hollow non-metallic extrusion 304, and further functions as the ground plane for the linear array. The top and bottom of each hollow non-metallic extrusion 304 are sealed from the environment with the end caps 212. The end caps 212 may include at least one interlocking mechanism, such as integral puzzle-locks, a plug, a socket, or a combination thereof. The puzzle-locks join the ends of adjacent linear array assemblies 206 together to provide additional structural strength.

FIG. 3B provides another detailed view 302 showing how the linear arrays, which have a plurality of linear array elements 308 and are attached to various metallized plastic extrusions 306, begin to slide into the hollow non-metallic extrusions 304. End caps 212, which may be made of plastic, are used to environmentally seal each linear array assembly 206. The hollow non-metallic extrusions 304 may have integral Gore-Tex patches, which facilitate air movement within the extrusion while preventing moisture intrusion.

In summary, the described invention overcomes the defects of conventional panel antenna arrays. The weight of the panel antenna array is reduced due to the use of hollow non-metallic extrusions, the elimination of metal fasteners, and the reduction in wind loading due to the openings between the linear array assemblies 206. The ease of assembly of a linear array subassembly comprising the metallized plastic extrusion 306 and the linear array, as well as the ease of insertion of the said subassembly into the hollow non-metallic extrusion 304 to form a linear array assembly 206 provide in a simplified fabrication and assembly process, thus reducing the overall antenna array costs. The performance matrix of the new panel antenna array is at least equal to or better than a conventional antenna array, while antenna reliability of the new panel antenna array is significantly increased due to its lack of mechanical fasteners and long environmental seals, and its use of plastic extrusions and caps to provide a sound environmental seal.

In another exemplary embodiment, the linear array assembly may be arranged in a circular or semi-circular fashion to yield the same assembly and fabrication benefits without degrading overall performance. In this exemplary embodiment, the linear array assemblies 206 may be parallel to one another and disposed around a circular or semi-circular member such as a circular or semi-circular mounting bracket.

The above illustration provides many different embodiments or embodiments for implementing different features of the invention. Specific embodiments of components and processes are described to help clarify the invention. These are, of course, merely embodiments and are not intended to limit the invention from that described in the claims.

Although the invention is illustrated and described herein as embodied in one or more specific examples, it is nevertheless not intended to be limited to the details shown, since various modifications and structural changes may be made therein without departing from the spirit of the invention and within the scope and range of equivalents of the claims. Accordingly, it is appropriate that the appended claims be construed broadly and in a manner consistent with the scope of the invention, as set forth in the following claims.

What is claimed is:

1. A panel antenna array system comprising:

a plurality of linear arrays of one or more linear array elements that provide antenna transmission and reception;

a corresponding plurality of substantially tubular protection modules disposed substantially parallel to each other, each protection module including an associated one of the associated linear arrays disposed therein, the protection modules fixedly spaced apart at a predetermined spacing that provides a resonant frequency for radio transmission and reception;

a mounting bracket with a mounting surface for receiving the protection modules joined thereto; and one or more radio frequency (RF) modules immediately attached to the mounting bracket via antenna feed points using an internal cable for providing one or more radio or electrical functions to the linear arrays.

2. The system of claim 1, wherein each protection module comprises a radome and the linear array is internally slidable with respect to the radome.

3. The system of claim 1, wherein the protection modules are hollow with opposed open ends.

4. The system of claim 1, wherein the protection modules each includes a flat surface that is joined to the mounting surface of the mounting bracket.

5. The system of claim 1, further comprising a centering module that centers and secures the linear array within each associated protection module in an upright fashion, each centering module disposed within the protection module and providing a ground plane for the linear array.

6. The system of claim 5, wherein the centering module is formed of plastic and includes a surface that is at least partly metal.

7. The system of claim 5, wherein the centering module includes one or more slots through which an associated linear array element protrudes.

8. The system of claim 1, further comprising at least one opening serving as a feed point at each protection module for accommodating an antenna feed to feed the linear array.

9. The system of claim 8, further comprising a structural adhesive sheet joining the protection modules to the mounting bracket, the structural adhesive sheet providing an environmental seal around the feed points.

10. The system of claim 1, further comprising end caps that cap opposed ends of the protection modules and are interlocked to secure adjacent protection modules together.

11. The system of claim 10, wherein the end caps are interlocked by at least one of an integral puzzle lock, a plug, and a socket.

12. The system of claim 10, wherein the protection modules are positioned vertically and the end caps are secured to tops and bottoms of the protection modules, with the end caps at the bottoms each including a value that allows condensed moisture to escape.

13. The system of claim 1, wherein the protection modules are arranged in a planar fashion.

14. The system of claim 1, wherein the protection modules are arranged in a circular fashion.

15. The system of claim 1, wherein each protection module is formed of non-metallic material.

16. The system of claim 1, wherein the protection modules each include a corresponding grounding plane therein.

17. The system of claim 1, wherein at least one of the protection modules has non-metallic patches for facilitating air movement therein and preventing moisture intrusion therefrom.

18. The system of claim 1, wherein each protection module is a hollow member that is an extrusion.

* * * * *